US006086358A

United States Patent [19]

Potskhishvili et al.

[11] Patent Number: 6,086,358

[45] Date of Patent: Jul. 11, 2000

[54] PIEZOELECTRIC GAS LIGHTER WITH SAFETY DEVICE

[76] Inventors: David Vakhtangovich Potskhishvili, B. Gruzinskaya, d.40, str.1, kv.19, Moskva, Russian Federation, 123056; Karlo Vakhtangovich Potskhishvili, Gldanskiy massiv II m.r.k.28. kv.73, Tbilisi, Ga. 38038

[21] Appl. No.: 09/434,010

[22] Filed: Nov. 4, 1999

[51] Int. Cl.[7] ..... F23D 11/36

[52] U.S. Cl. ..... 431/153; 431/255

[58] Field of Search ..... 431/153, 255

[56] References Cited

U.S. PATENT DOCUMENTS

| | | | |
|---|---|---|---|
| 4,832,596 | 5/1989 | Morris, Sr. | 431/153 |
| 5,145,358 | 9/1992 | Shike et al. | 431/255 |
| 5,462,432 | 10/1995 | Kim | 431/153 |
| 5,997,282 | 12/1999 | Mah | 431/153 |

FOREIGN PATENT DOCUMENTS

| | | |
|---|---|---|
| 0357347 | 3/1990 | European Pat. Off. . |
| 0488158 | 6/1992 | European Pat. Off. . |
| WO90/00239 | 1/1990 | WIPO . |
| WO90/12254 | 10/1990 | WIPO . |

*Primary Examiner*—Carroll Dority

*Attorney, Agent, or Firm*—Jacobson, Price, Holman & Stern, PLLC

[57] ABSTRACT

This invention relates to the field of energy and is directed to a piezoelectric gas lighter with protection from children. According to one of embodiments, such lighter comprises a cap movable in a direction along the body, which cap, in its upper portion, is provided with a rectangular cut-out for a button of the safety device, said button being positioned in this cut-out to move in guides along the cut-out. The button in the form of a plate is provided with protrusions directed toward the piezo-element, the protrusions being in the form of legs positioned with a gap with respect to the piezo-element such that the piezo-element is located between these legs. Said button is also provided with a support member having a socket for mounting therein one end of a button spring, another end of which is brought into contact with a support on the cap. Here, in the area of the piezo-element location, the body is provided with a protrusion directed toward the button, which protrusion is disposed by its height with a gap with respect to free ends of the button protrusions, when the button is pressed off in its upper position, while the body is provided with a support for the burner valve lever, which support is located in the area between the burner and piezo-element, to provide rocking of the lever when its free end is depressed by the button legs and to provide pressing-off of the burner lever in order to emit gaseous fuel to the atmosphere.

5 Claims, 9 Drawing Sheets

PIEZOELECTRIC GAS LIGHTER WITH SAFETY DEVICE

BACKGROUND OF THE INVENTION

The present invention relates to the field of energy and is directed to a gas lighter with protection from children, that is the lighter in which an ignition mechanism is combined with means for neutralizing this mechanism being movable between a operating neutralization position in which they prevent activating the ignition mechanism, and a position in which such activation is allowed, whereby these neutralization means are manually moved by a lighter user.

Lighters of this type are known which are described in WO No.A-90/00239 and EP No.A-0357347 wherein means for controlling the opening of a burner valve comprise a rocking lever hinged to a fixed axle of the orthogonal axis of the burner valve, one end of which in the form of horseshoe or enclosure is inserted under a flange of the burner valve while another end or actuating end are designed for activating the lighter by the user who moves it in a direction of the lighter body overcoming the force of a spring, while means for producing sparks are themselves independent or combined with the control lever for opening the valve, and wherein means for neutralizing the ignition mechanism are normally maintained in the neutralization position and are arranged so as to automatically return to the neutralization position at the end of activating the ignition mechanism.

A lighter is known, WO No.A-90/12254, of said type in which means for neutralizing the ignition mechanism comprise a button disposed under an actuating end of a rocking lever, being movable parallel to a longitudinal axis of this rocking lever between an operating position in which it (button) forms a protrusion relative to the actuating end of the lever, and an unnoticeable position in which it moves in a direction of another end of the rocking lever, whereby this button is provided with guiding means relative to the lighter body.

According to this known technical solution, the button has the shape of a horseshoe each end of which is made of elastic material and bears a protrusion, bulge, normally positioned under a bell (casing) encircling the actuating end of the rocking lever such as to prevent this rocking in a direction of the opening of the valve, whereby inner edges of side walls of the lighter body and the ends of the button are provided with additional converging inclined planes in order to cause reduction of the gap from their protrusions as the button moves in a removal position so as to completely free the path of the bell of the actuating end of the rocking lever, while the button and an outer rear edge of the bell of the actuating end of the rocking lever have additional inclined plane of the same inclination capable to act conjointly during release of this end of the rocking lever in order to cause movement of the button in the reverse direction to the operating neutralization position. It can be readily concluded that complexity of the shape of this button (pusher) and additional complexity of the upper portion of this lighter body substantially increase its cost.

A lighter is known, U.S. Pat. No. 4,832,596, in which means for controlling the opening of a valve comprise a rocking lever hinged to a fixed axle, orthogonal to an axis of burner valve of which one end is formed in the shape of a fork or enclosure and inserted under a flange of the burner valve, while another end of which, or an actuating end, is designed for a user to activate the lighter, who (user) pushes, displaces it in a direction of the lighter body overcoming the force of a back-moving spring, whereby spark producing means are themselves independent or combined with control lever for opening the valve, and in which an ignition mechanism is combined with means for neutralizing this mechanism comprising a member movable between an operating neutralization position in which it (member) prevents the control lever for opening the valve from being activated, having a portion disposed under a rear end which activates this lever, and an unnoticeable removal position in which it (member) allows such activation, whereby this member is moved manually by the lighter user from the operating neutralization position to the position of neutralization removal, and is typically retained in the neutralization position and, further, is so arranged that it can be automatically put in the neutralization position at the end of activation of the ignition mechanism.

In this lighter, the mobile movable member comprises a member slidably mounted and capable of being pulled out on the upper edge of its body, whereby said member has a curved rear and typically disposed under the rear end that activates the control lever, wherein said curved end is able to move back to the rear end which activates the control lever to a neutral position of this member. In this lighter the sliding and forward moving member is typically retained in the operating position by the back-moving spring and can move to the neutral position by a pressure applied to its front end. Accordingly, at the time of igniting the lighter, it is necessary to hold the forward moving member in the neutralization position at the same time when the control lever is activated which is not easy to effect using only one hand. On the other hand, due to the fact that this member is positioned by the side of a lighter head, this forward moving member runs the risk of being broken or damaged. Finally, its return to the operating position depends on the presence of its back-moving spring, and it also excessively protrudes beyond the body and there is the risk of it being lost and, consequently, its function would no more be performed which results in impossibility for the lighter to act as a lighter with protection from children.

A gas piezoelectric lighter is known, EP No.A-0488158, having a safety device intended to prevent the possibility of children igniting the lighter and comprising:

a driven cap driven movable in a direction along the body and disposed in the upper portion of the body and spring-pressed relative to the body, and provided with a safety device which has a first position wherein the cap is blocked from the downward movement to the side where the pressure is exerted on the piezo-element, and a second position in which the cap can be received within the body and exert the pressure on the piezo-element. The lighter has a burner valve with a lever for its pressing-off to emit to the atmosphere gaseous fuel stored in the body. The cap in the upper portion is provided with a rectangular cut-out positioned perpendicularly to a longitudinal axis of the body within which the safety device is located which is a button in the form of a rectangular plate disposed in the cap and movable along the cut-out in a direction perpendicular to the longitudinal axis of the lighter and able to return to the initial position under the action of a button spring. Here the button in the form of the rectangular plate has a protrusion directed toward the piezo-element such that in the initial position said protrusion is placed in a side cut-out of a body wall. At the same time, from the other side the button is supported by an additional support member secured to the body. With such double support, the cap cannot move downward since it is fixed relative to the body walls. When the button plate moves along the cut-out in the cap, the plate protrusion comes out of the side cut-out of the body wall which allows the cap to move downward to provide the possibility to produce a spark and ignite the gaseous fuel exiting from the burner valve.

Although this lighter has the ability to protect it from the use by children, it is insufficiently secure and reliable in use. The use of the lighter does not require increased attention and concentration with regard to actions performed during igniting. Generally, lighters of such type are produced for an attentive user who punctually follows instructions for use of such lighter. However, the practice shows that in using a lighter, it is not always possible to be highly attentive and concentrated as to performed actions when igniting because such actions are sometimes performed mechanically. In this connection, a situation arises when a user, not completely having removed the blocking, starts to depress the cap, and when resistance occurs to cap depressing, the burner valve lever also inadvertently increases the pressure on the cap which may cause break-down of the safety device or the lighter as a whole. Also cases are possible when the button of the safety device spontaneously displaces from the neutralization position due to accidental slight movement of the button which results in igniting the lighter by a child. Naturally, such shortcomings should be eliminated.

BRIEF DESCRIPTION OF THE INVENTION

The object of the present invention is to provide a gas piezoelectric lighter with protection from children which would have equivalent operating safety and a simpler design and which would be more convenient and safe in use due to the fact that switching-off the function of a safety device for blocking an ignition mechanism is effected only in a predetermined extreme position of a safety member, while in all other positions of the safety member the possibility remains to move lighter members which are inherent to a piezoelectric lighter not provided with such safety device.

According to the first embodiment, this task is solved by the fact that the piezoelectric lighter contains a driven cap positioned in the upper portion of the body and spring-pressed relative the body and movable in a direction along the body, said cap being provided with a safety device, a burner valve having a lever for its pressing-off to allow emission to the atmosphere of gaseous fuel stored in the body a spring for returning a button to the initial position after the force exerted on it on the part of a user has been removed.

In this embodiment, the cap in the upper portion is provided with a rectangular cut-out disposed perpendicularly to a longitudinal axis of the body, while the safety device comprises a button in the form of a rectangular plate positioned in the upper portion of the cap and movable in guides along said cut-out in a direction perpendicular to the longitudinal axis of the lighter body. Here the guides for button movement comprise longitudinal protrusions in walls of the cut-out in the cap and longitudinal grooves in button side walls.

The button in the form of the rectangular plate is provided with protrusions directed toward the piezo-element in the form of two legs spaced apart from the piezo-element such that the piezo-element is located between said legs.

Said button is also provided with a support member having a socket for mounting therein one end of button spring another end of which is brought into contact with the support on the cap.

In the area of location of the piezo-element on the body there is provided a protrusion directed toward the button which is disposed at the same height with the gap relative to free ends of the button protrusions.

The body is also provided with a support member for the burner valve lever, said support member being positioned on the portion between the burner and piezo-element to provide rocking of the lever when its free end is depressed and to provide pressing-off of the burner valve in order to emit the gaseous fuel to the atmosphere.

According to the second embodiment this task is accomplished by the fact that the piezoelectric lighter comprises a driven cap located in the upper portion of the body and spring-pressed relative to the body and movable in a direction along the body, which cap is provided with a safety device, a burner valve having a lever for its pressing-off in order to emit the gaseous fuel stored in the body to the atmosphere, a spring for returning the button to the initial position after the force exerted on it by the use has been removed.

The cap in the upper portion is provided with a rectangular cut-out disposed perpendicularly to a longitudinal axis of the body, while the safety device comprises a button in the form of a rectangular plate positioned in the upper portion of the cap and movable in guides along the cut-out in a direction perpendicular to the longitudinal axis of the lighter body. Here the guides for button movement comprise longitudinal protrusions in walls of the cut-out in the cap and longitudinal grooves in the button side walls.

The button in the form of the rectangular plate is provided with a protrusion directed toward the piezo-element, said protrusion being in the form of a wall spaced apart from the piezo-element in the area between the piezo-element and a free end of a burner valve lever.

Said button is also provided with a support member having a socket for mounting therein one end of a button spring another end of which is brought into contact with the support on the cap.

In the area between the piezo-element and the free end of the burner lever, on the body there is provided a protrusion directed toward the button with is disposed at the same height with the gap with respect to the lower edge of the button protrusion. The body is also provided with a support member for the burner valve lever, said support member being positioned on the portion between the burner and the piezo-element to provide rocking of the lever when its free end is depressed by the button protrusion and to provide pressing-off of the burner valve in order emit the gaseous fuel to the atmosphere.

According to the third embodiment the task is accomplished by the fact that the piezoelectric lighter comprises a drive cap positioned in the upper part of the body and spring-pressed relative to the body and movable in a direction along the body, said cap being provided with a safety device, a burner valve having a lever for its pressing-off in order to emit to the atmosphere gaseous fuel stored within the body, a spring for returning the button to the initial position after the force exerted on it by the user has been removed.

The cap in its upper portion is provided with a rectangular cut-out disposed perpendicularly to a longitudinal axis of the body, while the safety device comprises a button in the form of a rectangular plate positioned in the upper portion of the cap and movable in guides along the cut-out in a direction perpendicular to the longitudinal axis of the lighter body. Here the guides for button movement comprise longitudinal protrusions in walls of the cut-out in the cap and longitudinal grooves in the button side walls.

The button in the form of rectangular plate is provided with a protrusion directed toward of the piezo-element, said protrusion being in the form of a wall being a support member and having a socket for mounting therein on end of a button spring another end of which is brought into contact with the support on the cap.

In the area between the free end of the burner lever and the button protrusion, on the body there is provided a protrusion directed toward the button disposed at its height with a gap relative to the lower edge of the button protrusion. The body is also provided with a support member for the burner valve lever, said support member being positioned on the portion between the burner and the piezo-element to provide rocking of the lever when its free end is depressed by the button protrusion and to provide pressing-off of the burner valve in order to emit the gaseous fuel to the atmosphere. Here the free end of the burner valve lever, the body protrusion and the button protrusion are located in the area between the piezo-element and the side wall of the cap from the side opposite to the position of said burner valve.

According to the fourth embodiment, the task is solved by the fact that the piezoelectric lighter comprises a driven cap located in the upper portion of the body and spring-pressed relative to the body and movable in a direction along the body, said cap being provided with a safety device, a burner valve having a lever for its pressing-off in order to emit the gaseous fuel stored within the body to the atmosphere, a spring for returning the button to the initial position after the force exerted in it by the user has been removed.

The cap in its upper portion is provided with a rectangular cut-out disposed perpendicularly to a longitudinal axis of the body, while the safety device comprises a button in the form of a rectangular plate positioned in the upper portion of the cap and movable in guides along the cut-out in a direction perpendicular to the longitudinal axis of the lighter body. Here the guides for button movement comprise longitudinal protrusions in walls of the cut-out in the cap and longitudinal grooves in the button side walls.

The button in the form of the rectangular plate is provided with two protrusions directed toward the piezo-element, each of the protrusions being formed as a wall. One of the button protrusions located from the side of the cap sidewall is a support member having a socket for mounting therein one end of a button spring another end of which is brought into contact with the support on the cap. The other of the button protrusions is positioned between the free end of the burner valve lever and the piezo-element.

In the area between the piezo-element and the button protrusion, which is a support member for the button spring, on the body there is provided a protrusion directed toward the button which is disposed at its height with a gap relative to the lower edge of the protrusion which is a support member for the button spring. The body is provided with a support for the burner valve lever, which support is located in the area between the burner and piezo-element to provide rocking of the lever when its free end is depressed by the button protrusion and to provide pressing-off of the burner valve in order to emit the gaseous fuel to the atmosphere. Here the free end of the burner valve lever and one of the button protrusions are disposed, relative to the piezo-element, from the side of the burner valve, while the other button protrusion, being the support member for the button spring, and the body protrusion are located from the other side of the piezo-element in the area of the cap side wall from the side opposite to the position of the burner valve.

According to the fifth embodiment, the task is accomplished by the fact that the piezoelectric lighter comprises a driven cap located in the upper part of the body and spring-pressed relative to the body and movable in a direction along the body, said cap being provided with a safety device, a burner valve having a lever for its pressing-off in order to emit the gaseous fuel stored within the body to the atmosphere, a spring for returning the button to the initial position after the force exerted on it by the user has been removed.

The cap in its upper portion is provided with a rectangular cut-out disposed perpendicularly to a longitudinal axis of the body, while the safety device comprises a button in the form of a rectangular plate positioned in the upper portion of the cap and movable in guides along the cut-out in a direction perpendicular to the longitudinal axis of the lighter body. Here the guides for button movement comprise longitudinal protrusions in walls of the cut-out in the cap and longitudinal grooves in the button sidewalls.

The button in the form of the rectangular plate is provided with a protrusion directed toward the piezo-element, said protrusion being formed as a wall positioned from the side of the cap side wall and being a support member having a socket for mounting therein one end of a button spring another end of which is brought into contact with the support on the cap. The button in the form of the rectangular plate is also provided with legs directed toward the piezo-element, which legs are disposed with a gap relative to the piezo-element such that the piezo-element is located between said legs.

In the area between the piezo-element and the button protrusion, being the support member for the button spring, on the body there is provided a protrusion directed toward the button and disposed at its length with the gap relative to the lower edge of the protrusion which is the support member for the button spring.

The body is also provided with a support for the burner valve lever, which support is located in the area between the burner and the piezo-element to provide rocking of the lever when its free end is depressed by the button legs and to provide pressing off of the burner valve in order to emit the gaseous fuel to the atmosphere.

Here the free end of the burner valve lever and the button legs are disposed, relative to the piezo-element, from the side of the burner valve, while button protrusion in the form of the wall, being the support member for the button spring, and the body protrusion are located at the other side of the piezo-element, in the area of the cap side wall from the side opposite to the position of the burner valve.

DETAILED DESCRIPTION OF THE DRAWINGS

The present invention is illustrated by the following drawings which represent preferred embodiments according to each variant but are not unique and demonstrate the possibility to achieve the desired result with the recited totalities of essential features.

Figure 2:
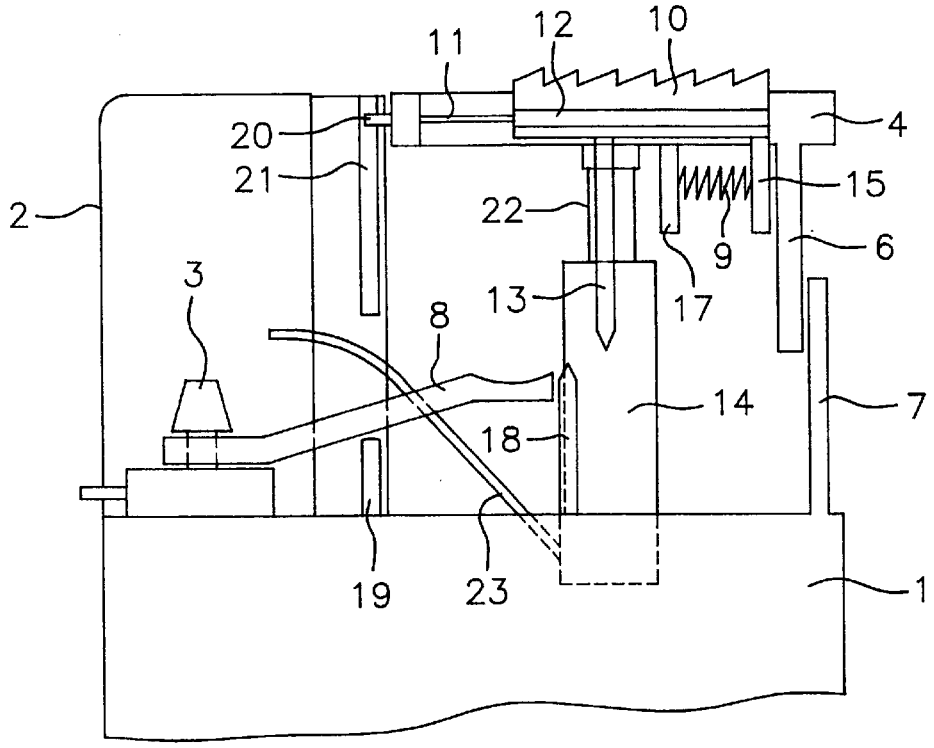
FIG. 2 is a side view of the lighter according to the first embodiment when a button of the safety device is in the position corresponding to neutralization mode.
Figure 3:
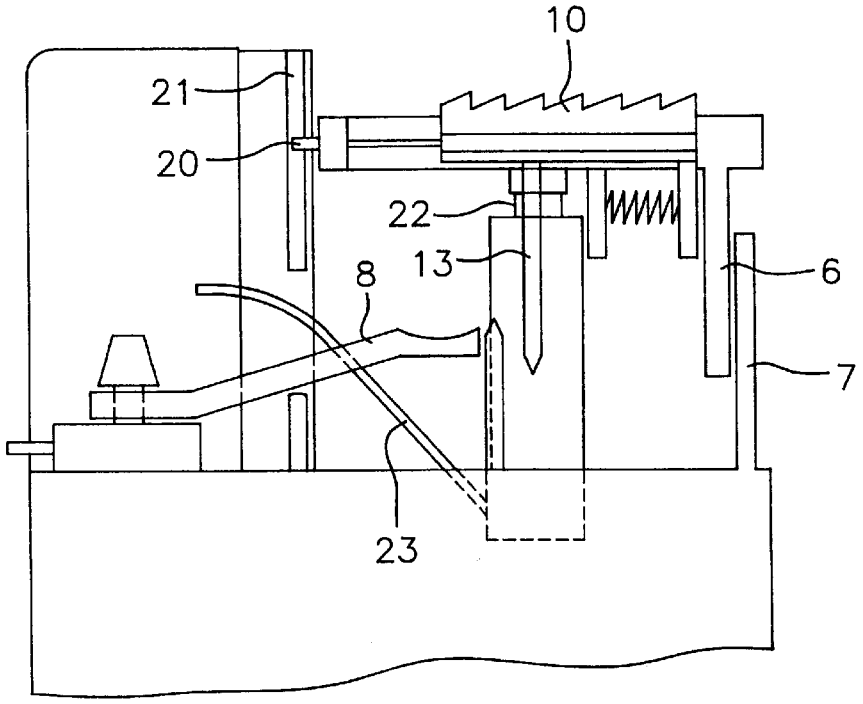
Figure 4:
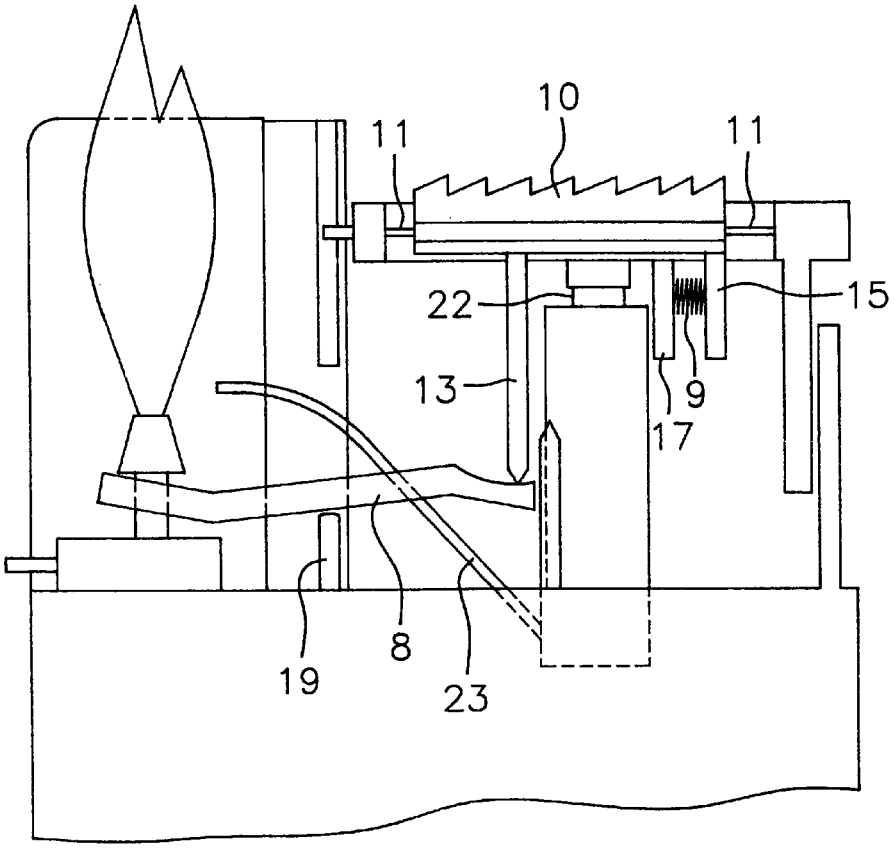
Figure 5:
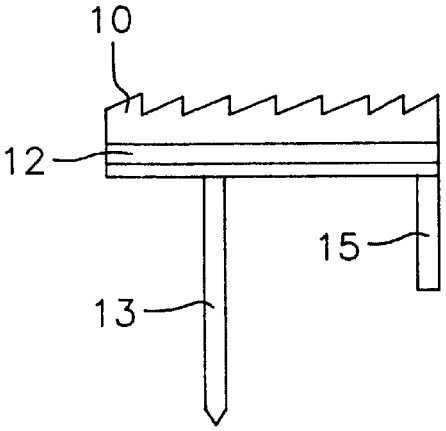
Figure 6:
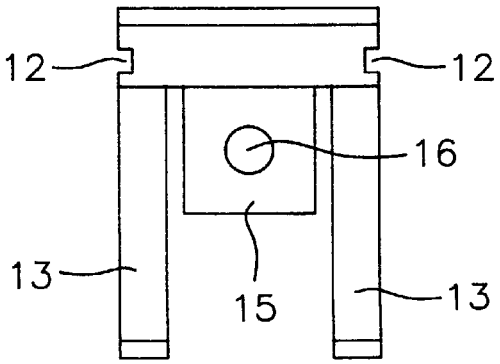
Figure 7:
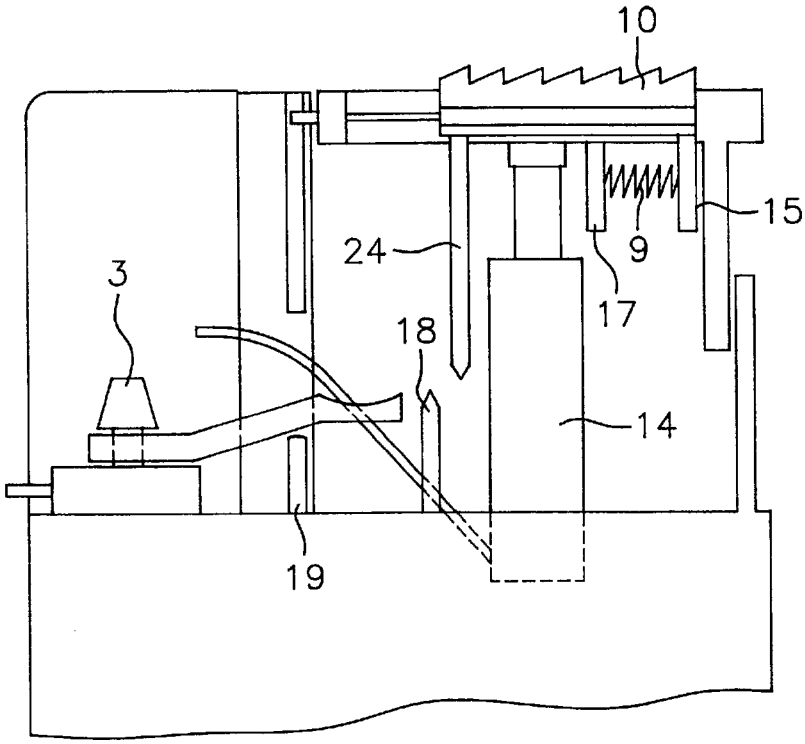
Figure 8:
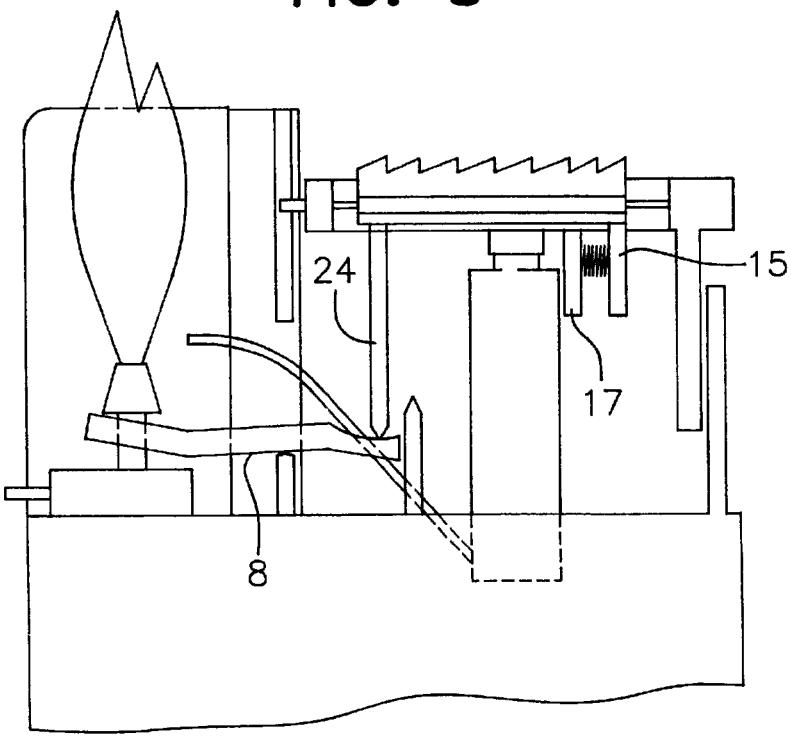
Figure 9:
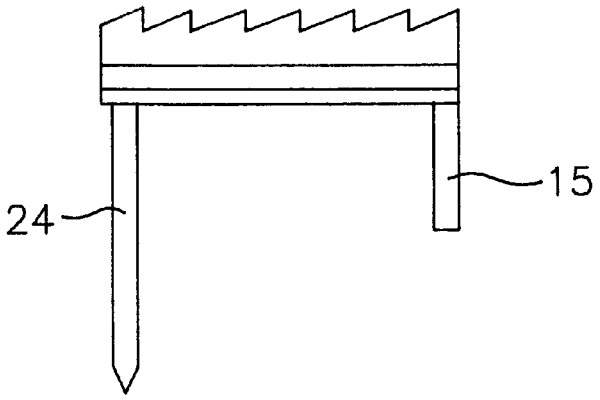
Figure 10:
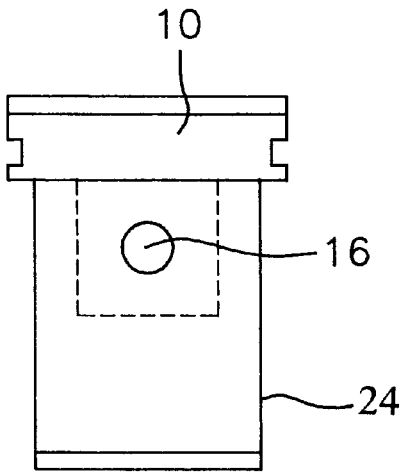
Figure 11:
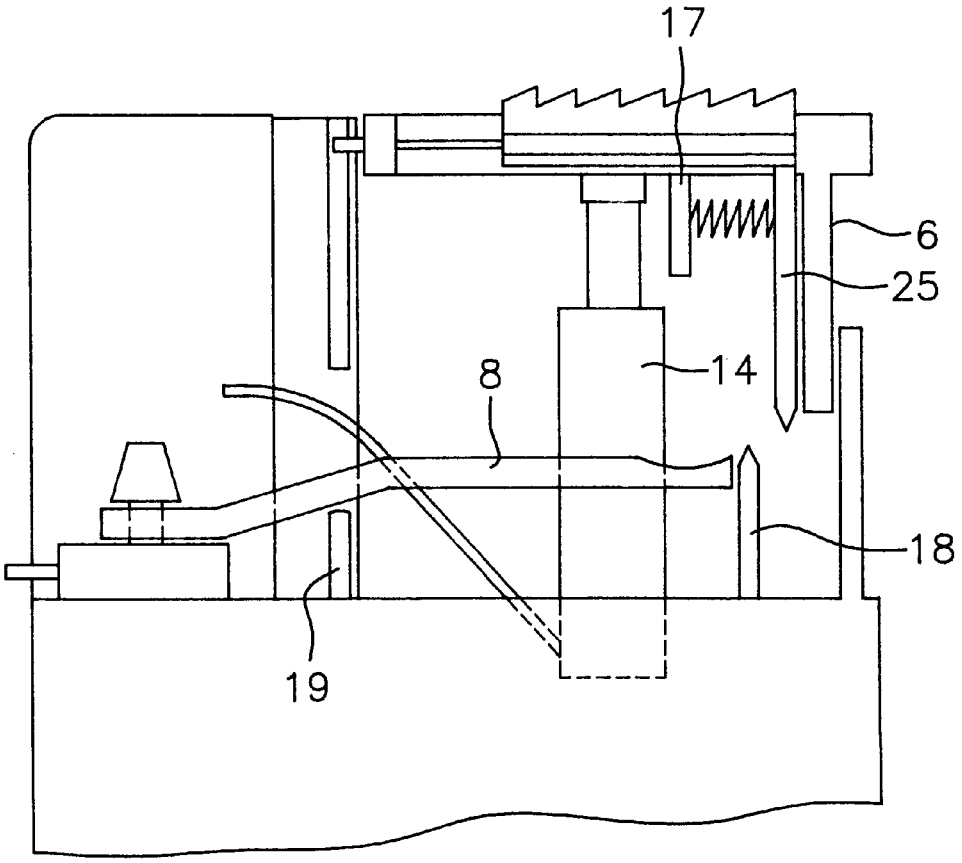
Figure 12:
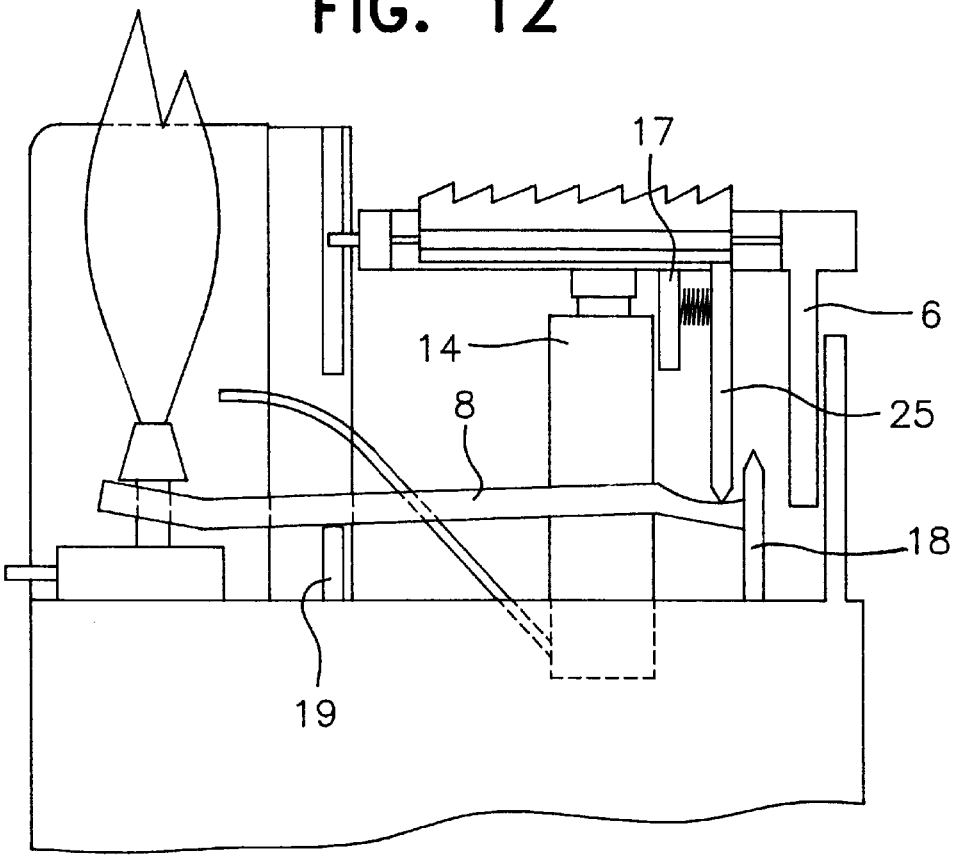
Figure 13:
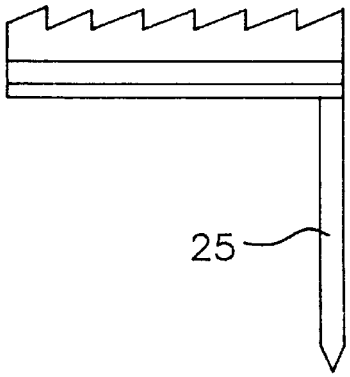
Figure 14:
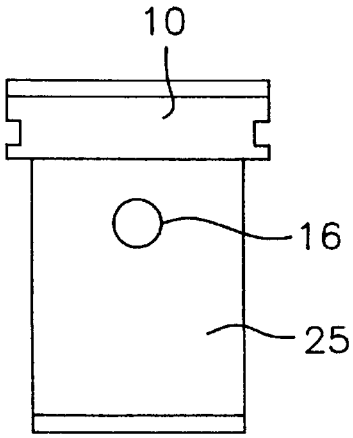
Figure 15:
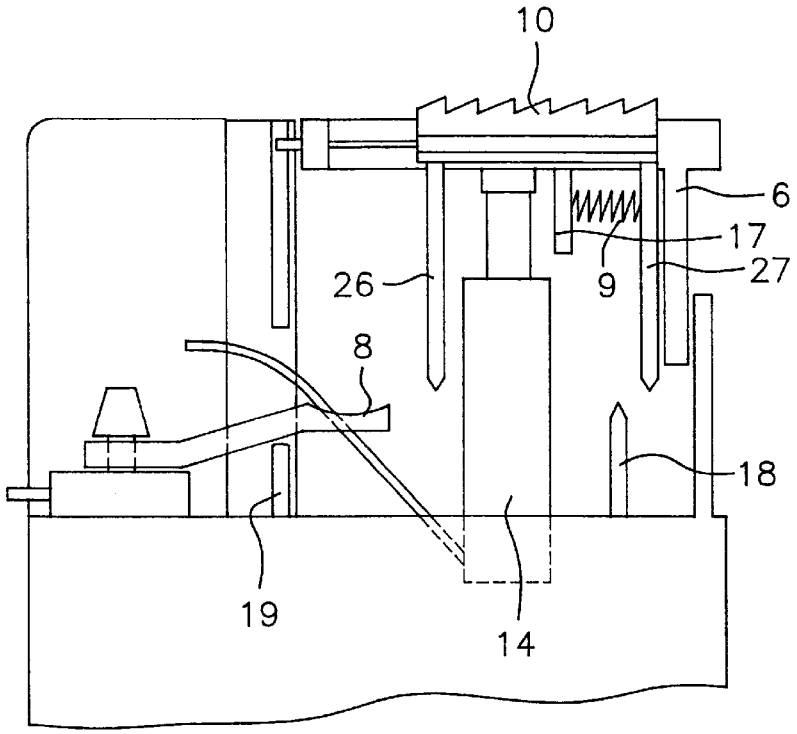
Figure 16:
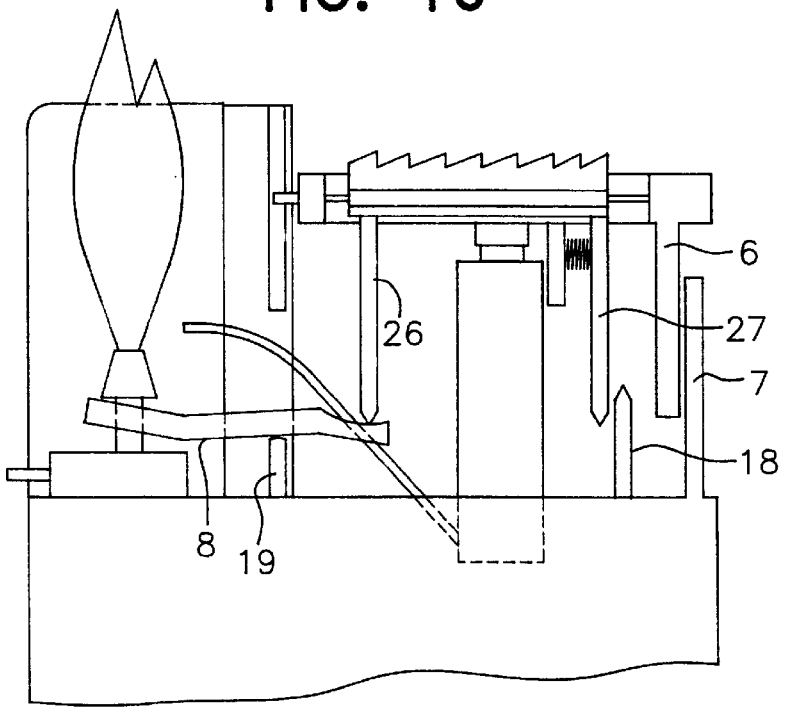
Figure 17:
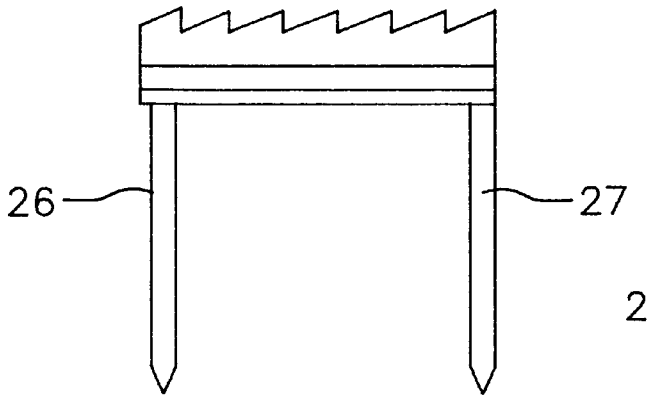
Figure 18:
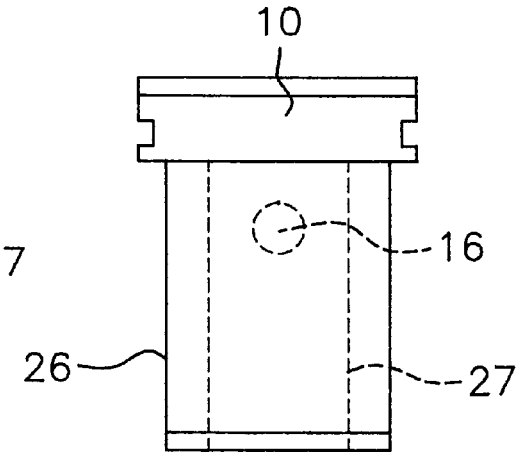
Figure 19:
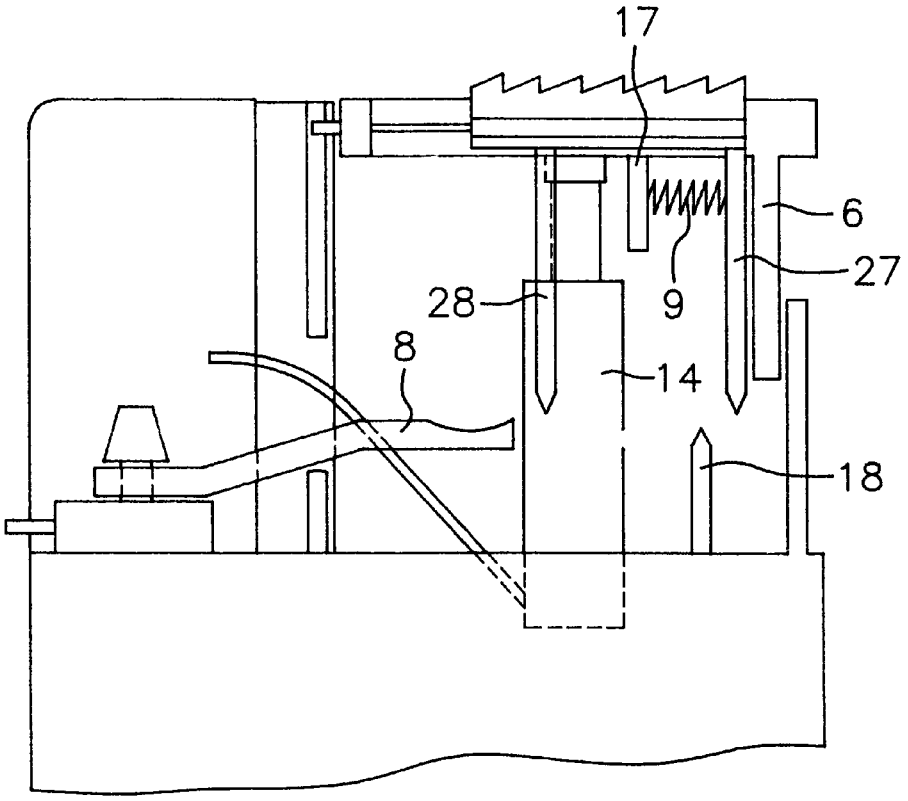
Figure 20:
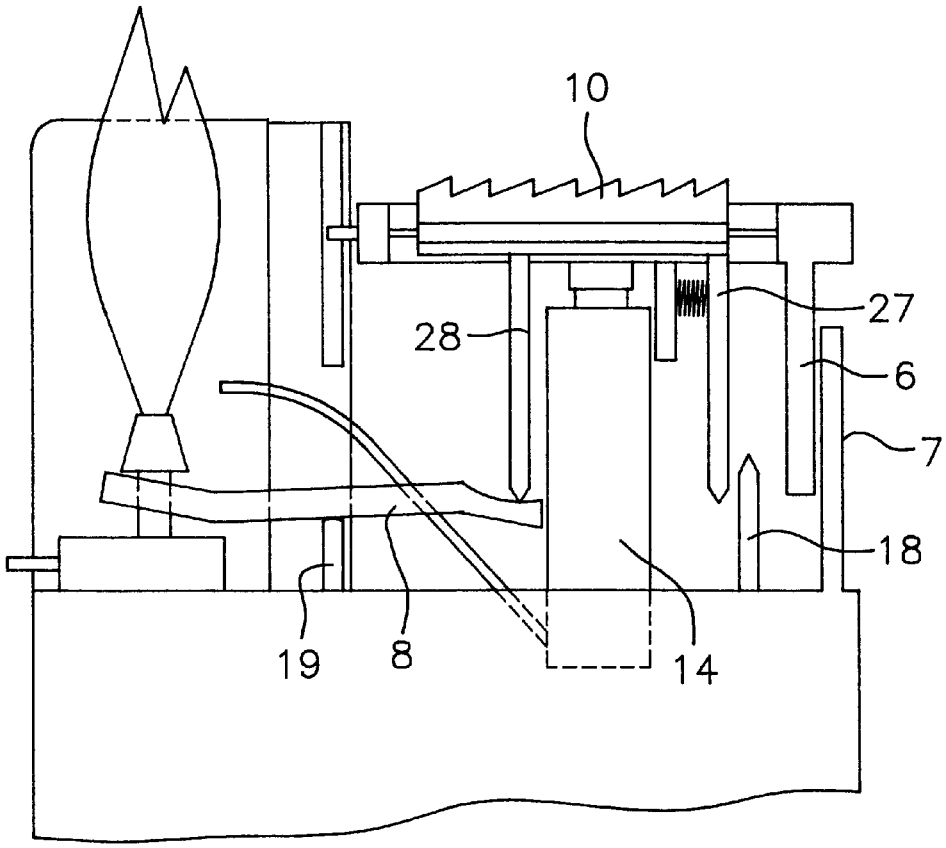
Figure 21:
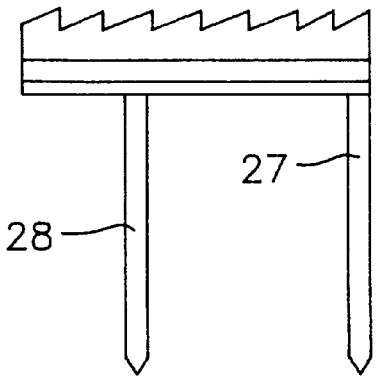
Figure 22:
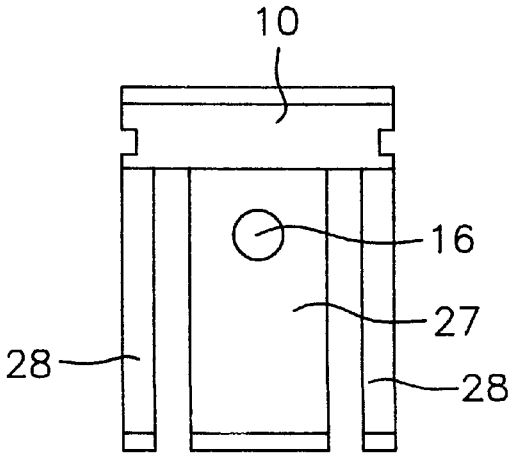

FIG. 3 presents the same position of elements of the safety device as in FIG. 2 when a user depresses a control device in the neutralization mode;

FIG. 4 shows the same as FIG. 2 when the safety device is turned off;

FIG. 5 is a side view of the button of safety device for the lighter according to the first embodiment;

FIG. 6 is a front view of the button of FIG. 5;

FIG. 7 is a side view of the lighter according to the second embodiment when the position of the button of safety device corresponds the neutralization mode;

FIG. 8 shows the same position of the elements of safety device as in FIG. 7 when the user depresses the control lever in the turned-off neutralization mode;

FIG. 9 is a side view of the button of safety device for the lighter according to the second embodiment;

FIG. 10 is a front view of the button of FIG. 9;

FIG. 11 is a side view of the lighter according to the third embodiment when the position of the button of safety device corresponds to the neutralization mode;

FIG. 12 shows the same position of the elements of safety device as in FIG. 11 when the user depresses the control lever in the turned-off neutralization mode;

FIG. 13 is a side view of the button of safety device for the lighter according to the third embodiment;

FIG. 14 is a front view of the button of FIG. 13;

FIG. 15 is a side view of the lighter according to the fourth embodiment when the position of the button of safety device corresponds to the neutralization mode;

FIG. 16 shows the same position of the elements of safety device when the user depresses the control lever in the turned-off neutralization mode;

FIG. 17 is a side view of the button of safety device for the lighter according to the fourth embodiment;

FIG. 18 is a front view of the button of FIG. 17;

FIG. 19 is a side view of the lighter according to the fifth embodiment when the button of safety device is in the position corresponding to the neutralization mode;

FIG. 20 shows the same position of the elements of safety device as in FIG. 19 when the user depresses the control lever in the turned-off neutralization mode;

FIG. 21 is a side view of the button of safety device for the lighter according to the fifth embodiment;

FIG. 22 is a front view of the button of FIG. 21.

DETAILED DESCRIPTION OF THE INVENTION

Figure 1:
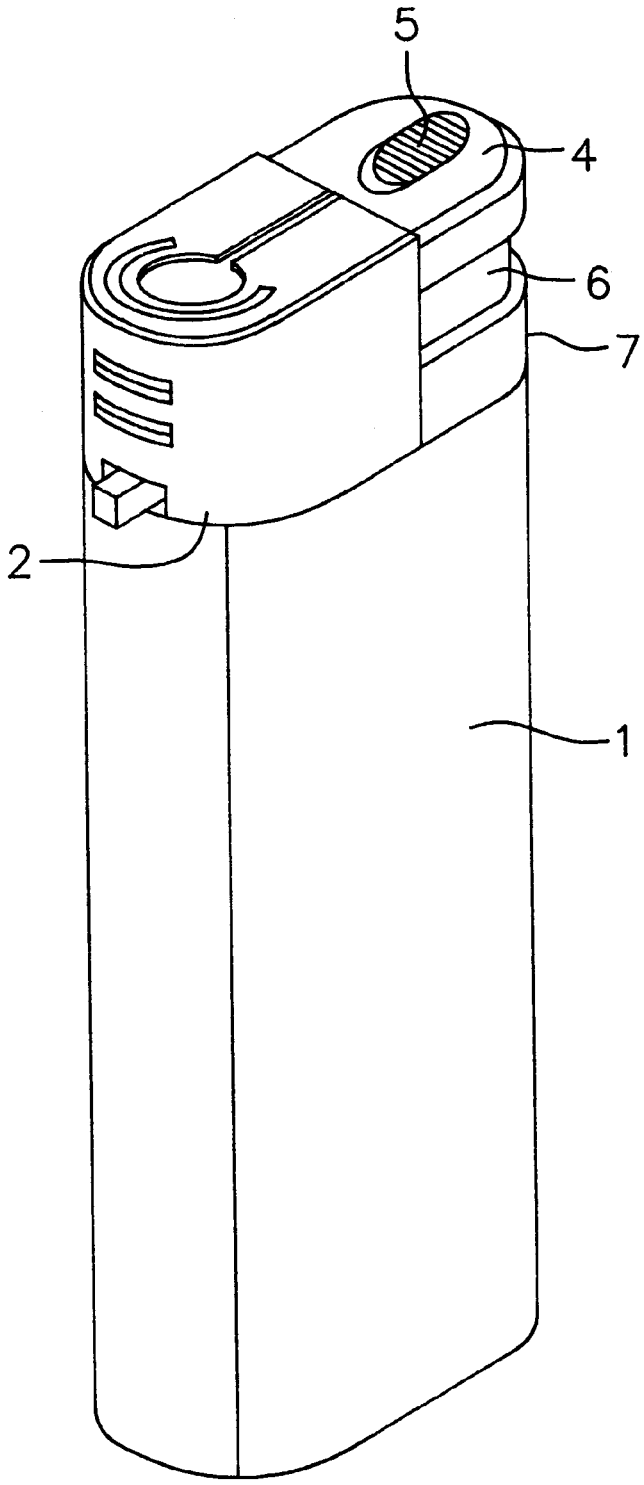
FIG. 1 is a general view of a piezoelectric lighter with safety device.

As shown in FIG. 1, the lighter for all embodiments according to the invention is a gas piezoelectric lighter a hollow body 1 of which, made of a polymeric or other material, is a receptacle for a liquefied gas which is a gaseous fuel. From the top, the body is closed with a metal cover 2 provided with slits for supplying air and with an opening for exit of flame and closing a head of valve of burner 3. Beside the cover 2, in the upper part of the body there is provided a driven cap 4 spring-pressed relative to the body and movable in a direction along the body, which cap is provided with a safety device 5 and having a sidewall 6 which is also a sliding guide for the cap when it is received inside the body cavity restricted by wall 7 of the body. The cap is spring-pressed relative the body such that when the pressure is removed form the cap, the latter returns to the initial position, shown in FIG. 1. The burner 3 valve has a lever 8 of its pressing-off in order to emit to the atmosphere the gaseous fuel stored within the body. The button return to the initial position after the force exerted on it by the user has been remove is effected due to force of the spring 9. Within the scope of the present invention, by the initial position of the button is meant the position in which neutralizing of the gas ignition mechanism occurs. Here the present invention is considered with respect to the lighter positioned relative to any supporting surface vertically, as shown in FIG. 1.

Cap 4 in the upper portion is provided with an elongate cut-out disposed perpendicularly to a longitudinal axis of the body (by the longitudinal axis is meant any axis extending in a direction from the cap to the base of the body perpendicularly to the plane of the body base), while the safety devise comprises a button 10 in the form of a rectangular plate disposed in the upper portion of the cap and movable in guides along the cut-out in a direction perpendicular to the longitudinal axis of the lighter body. Here the guides for the button movement comprise longitudinal protrusions 11 in wall of the cut-out in the cap and longitudinal grooves 12 in the button side walls.

According to the first embodiment of the piezoelectric lighter shown in FIGS. 2 to 6, button 10 in the form of the rectangular plate is provided with protrusions in the form of two legs 13 directed toward the piezo-element, which legs are arranged with a gap with respect to the piezo-element 14 such that piezo-element 14 is placed between these legs. The button is also provided with a support member 15 having a socket 16 for mounting therein one end of a button spring 9 another end of which is brought into contact with support 17 on the cap.

In the area where the piezo-element 14 is position on the body, there is provided a protrusion 18 directed toward the button and located by its height with the gap with respect to free ends of the button legs 13.

The body is also provided with a support 19 for lever 8 of the burner valve, said support being positioned in the area between the burner valve and the piezo-element to provide rocking of the lever 8 when legs 13 depress its free end and to provide pressing-off of the burner valve in order to emit the gaseous fuel to the atmosphere.

The oriented downward movement of the cap toward the lighter body is effected by sliding the side wall 6 of the cap along the inner surface of wall 7 of the body 1 and by sliding protrusion 20 of the cap along the vertical groove 21 in the body 1.

Piezo-element 14 consists of two parts: a fixed part secured in the lighter body and a movable part 22 on which the cap exerts pressure when it moves downward. A conductor 23 providing sparking extends from the piezo-element 14 to the area of the valve head.

The piezoelectric lighter according to the first embodiment is operated as follows.

Neutralization mode. The button on the cap is in its extreme right position which is provided by the force of spring 9. When the cap is depressed, the latter is received by the body while exerting pressure on the piezo-element 14 which insures sparking at the end of conductor 23.

However, despite the fact that the cap is received, no ignition of the gas occurs since the burner valve is not pressed off by lever 8 (FIG. 3). As the cap moves in the neutralization mode, legs 13 do not get on the free ends of lever 8 because they are by the other side from the body protrusion 18.

When the button moves toward the burner valve while the cap is received in its lower position, legs 13 of the button bear against protrusion 18 of the body which excludes their interaction with the burner valve lever 8.

Turned-off neutralization mode. To turn neutralization off, it is necessary, in the upper pressed-off position of the cap, to move the button, overcoming the force of spring 9, in a direction of the burner valve until it abuts the wall of the cap cut-out. In this position, the button legs 13 are over the free ends of the burner valve lever 8 and in front of the body protrusion 18.

When the cap is depressed and moves downward, simultaneously opening of the burner valve and sparking occur due to the pressure exerted on the piezo-element (FIG. 4).

Once the force has been simultaneously removed both from the button and the cap, the cap will rise upward, take the initial position, while the button, under the action of spring 9, will move to the initial extreme position wherein legs 13 will be located with respect to protrusion 18 of the body from the side opposite the position of the burner valve.

Thus it can be seen that with any incidental depressing of the cap or with depressing of the cap and with incomplete movement of the button, the possibility of igniting the gas within the lighter is eliminated. While all the lighter elements retain their mobility which prevents it from being broken at an increased force applied to the cap.

Below the four additional embodiments of a piezoelectric lighter are described where examples of various arrangements and implementations of button elements with respect to the location of the piezo-element are considered.

According to the second embodiment, shown in FIGS. 7 to 10, in a piezoelectric lighter, a button in the form of a rectangular plate is provided with a protrusion 24 directed toward the piezo-element 14, said protrusion being in the form of a wall or barrier disposed with a gap with regard to the piezo-element 14 in the area between piezo-element 14 and a free end of a burner valve lever 8. Said button is also provided with a support member 15 having a socket 16 for mounting therein one end of button spring 9, another end of which is brought into contact with a support 17 on a cap.

In the area between the piezo-element 14 and the free end of the burner lever 8 the body is provided with a protrusion 18 directed toward the button, which protrusion is positioned at its height with a gap with respect to the lower edge of the button protrusion. The body is also provided with a support 19 for the burner valve lever, said support being located in the area between the burner and piezo-element to provide rocking of the lever when its free end is depressed by the button protrusion 24 and provide pressing of burner valve 3 in order to emit the gaseous fuel to the atmosphere. This embodiment differs from the first one in that the protrusion 24 in the form of the wall is position in front of the piezo-element 14 from the side of the burner valve and between the body protrusion 18 and piezo-element.

According to the third embodiment, presented in FIGS. 11 to 14, in a piezoelectric lighter, a button in the form of a rectangular plate is provided with a protrusion 25 directed toward the piezo-element 14, which protrusion is in the form of a wall or barrier and is a support member having a socket 16 for mounting therein one end of a button spring, another end of which is brought into contact with a support 17 on a cap.

In the area between a free end of a burner valve and a button protrusion, the body is also provided with a protrusion 18 directed toward the button, said protrusion being located at its height with a gap with respect to the lower edge of the button protrusion 25. The body is also provided with a support 19 for a burner valve lever disposed in the area between the burner valve and the piezo-element 14 to provide rocking of the lever when its free end is depressed by button protrusion 25 and to provide pressing-off of the burner valve in order to emit gaseous fuel to the atmosphere. Here the free end of the burner valve lever 8, the body protrusion 18 and the button protrusion 25 are located in the area between the piezo-element and a side wall 6 of the cap with respect to the piezo-element 14 from the side opposite the position of the burner valve.

According to the fourth embodiment, shown in FIGS. 15 to 18, in a piezoelectric lighter, a button in the form of a rectangular plate is provided with two protrusions 26 and 27 directed toward the piezo-element, each of said protrusions being formed as a wall or barrier. The button protrusion 27 located from the side of a side wall 6 of a cap is a support member having a socket 16 for mounting therein one end of button spring 9, another end of which is brought into contact with a support 17 on the cap. The button protrusion 26 is disposed between a free end of the burner valve lever 8 and the piezo-element 14.

In the area between the piezo-element 14 and the button protrusion 27 which is a support element for button spring 9, the body is provided with a protrusion 18 directed toward the button, which protrusion is located by its height with a gap with respect to the lower edge of protrusion 27 which is a support member for the button spring. The body is also provided with a support 19 for the burner valve lever located in the area between the burner valve and the piezo-element to provide rocking of lever 8 when its free end is depressed by the button protrusion 26 and to provide pressing-off of the burner valve in order to emit gaseous fuel to the atmosphere. Here the free end of the burner valve lever and button protrusion 26 are disposed, with respect to the piezo-element 14, from the side of the burner valve, while the other button protrusion 27, being a support member for the button spring, and body protrusion 18 are disposed by the other side of the piezo-element in the area of cap sidewall 6 from the side opposite the burner valve position.

According to the fifth embodiment, presented in FIGS. 19 to 22, in a piezoelectric lighter, a button in the form of a rectangular plate is provided with a protrusion 27 directed toward the piezo-element, which protrusion is provided in the form of a wall or barrier located from the side of side wall 6 of a cap and being a support member having a socket 16 for mounting therein one end of the button spring 9, another end of which is brought into contact with support 17 on the cap. The button in the form of rectangular plate is also provided with two legs 28 directed toward the piezo-element and located with a gap with respect to the piezo-element 14 such that the piezo-element is disposed between said legs.

In the area between the piezo-element and button protrusion 27 which is a support member for the button spring, the body is provided with protrusion 18 directed by its height with a gap with respect to the lower edge of protrusion 27 which is a support member for the button spring.

The body is also provided with a support for the burner valve lever, which support is disposed in the area between the burner and the piezo-element to provide rocking of the lever when its free end is depressed by legs 28 of the button and to press off the burner valve in order to emit the gaseous fuel to the atmosphere.

Here the free end of burner valve lever 8 and button legs 28 are disposed, with respect to the piezo-element 14, form the side of the burner valve while button protrusion 27 in the form of the wall, which is the support member for the button spring, and body protrusion 18 are disposed by the other side of the piezo-element 14 in the area of side wall 6 of the cap from the side opposite the burner valve position.

The piezoelectric lighters according to all the embodiments, starting from the second one, operate according to the same principle as the lighter according to the first embodiment.

We claim:

1. A piezoelectric gas lighter with safety device designed to prevent children from the possibility of igniting the lighter, comprising:

a driven cap disposed in the upper portion of the body and spring-pressed relative to the body and movable in a direction along the body, said cap being provided with a safety device;

a burner valve having a lever for its pressing-off in order to emit to the atmosphere gaseous fuel stored within the body, said cap in the upper portion being provided with a rectangular cut-out positioned perpendicularly to a longitudinal axis of said body, said safety device comprising a button in the form of a rectangular plate disposed in the upper portion of said cap and movable in guide means along said cut-out in a direction perpendicular to said longitudinal axis of the lighter body, a spring for returning said button in the initial position after the pressure applied on in on the part of a user has been removed, said button in the form of the rectangular plate being provided with protrusions directed toward a piezo-element, which protrusions are in the form of two legs located with a gap with respect to the piezo-element such that said piezo-element is positioned between said legs, said button being provided with a support member having a socket for mounting therein one end of said button spring, another end of which is brought into contact with a support on the cap, said guide means for button movement comprising longitudinal protrusions in walls of said cut-out in said cap and longitudinal grooves in side walls of the button, in the area of said piezo-element location, the body being provided with a protrusion directed toward said button, said protrusion being positioned by its height with a gap with respect to free ends of said button protrusions when the button is pressed off in its upper position, said body being provided with a support for the burner valve lever, which support is located in the area between the burner and piezo-element, to provide rocking of said lever when its free end is depressed by said button legs and to provide pressing-off of said burner valve in order to emit gaseous fuel to the atmosphere.

2. A piezoelectric gas lighter with safety device designed to prevent children from the possibility of igniting the lighter, comprising:

a driven cap disposed in the upper portion of the body and spring-pressed relative to the body and movable in a direction along the body, said cap being provided with a safety device, a burner valve having a lever for its pressing-off in order to emit to the atmosphere gaseous fuel stored within the body, said cap in the upper portion being provided with a rectangular cut-out positioned perpendicularly to a longitudinal axis of said body, said safety device comprising a button in the form of a rectangular plate disposed in the upper portion of said cap and movable in guide means along said cut-out in a direction perpendicular to said longitudinal axis of the lighter body, a spring for returning said button in the initial position after the pressure applied on it on the part of a user has been removed, said button in the form of the rectangular plate being provided with a protrusion directed toward the piezo-element, which protrusion is in the form of a wall or barrier located with a gap with respect to the piezo-element in the area between said piezo-element and a free end of the burner valve lever, said button being provided with a support member having a socket for mounting therein one end of said button spring, another end of which is brought into contact with a support on the cap, said guide means for button movement comprising longitudinal protrusions in walls of said cut-out in said cap and longitudinal grooves in side walls of the button, in the area between the piezo-element and the free end of the burner lever, the body being provided with a protrusion directed toward said button, said protrusion being positioned by its height with a gap with respect to the lower edge of said button protrusion, said body being provided with a support for the burner valve lever, which support is located in the area between the burner and piezo-element to provide rocking of said lever when its free end is depressed by said button protrusion and to provide pressing-off of the burner valve in order to emit gaseous fuel to the atmosphere.

3. A piezoelectric gas lighter with safety device designed to prevent children from the possibility of igniting the lighter, comprising:

a driven cap disposed in the upper portion of the body and spring-pressed relative to the body and movable in a direction along the body, said cap being provided with a safety device, a burner valve having a lever for its pressing-off in order to emit to the atmosphere gaseous fuel stored within the body, said cap in the upper portion being provided with a rectangular cut-out positioned perpendicularly to a longitudinal axis of said body, said safety device comprising a button in the form of a rectangular plate disposed in the upper portion of said cap and movable in guide means along said cut-out in a direction perpendicular to said longitudinal axis of the lighter body, a spring for returning said button to the initial position after the pressure applied on it on the part of a user has been removed, said button in the form of the rectangular plate being provided with a protrusion directed toward the piezo-element, which protrusion is in the form of a wall or barrier which is a support member having a socket for mounting therein one end of said button spring, another end of which is brought into contact with a support on the cap, said guide means for button movement comprising longitudinal protrusions in walls of said cut-out in said cap and longitudinal grooves in side walls of the button, in the area between the free end of said burner valve lever and said button protrusion, the body being provided with a protrusion directed toward said button, said protrusion being positioned by its height with a gap with respect to the lower edge of said button protrusion, said body being provided with a support for the burner valve lever, which support is located in the area between said burner and said piezo-element to provide rocking of said lever when its free end is depressed by said button protrusion and to provide pressing-off of said burner valve in order to emit the gaseous fuel to the atmosphere, wherein the free end of said burner valve lever, said body protrusion and said button protrusion are located in the area between the piezo-element and the cap side wall from the side opposite the burner valve position.

4. A piezoelectric gas lighter with a safety device designed to prevent children from the possibility of igniting the lighter, comprising:

a driven cap disposed in the upper portion of the body and spring-pressed relative to the body and movable in a direction along the body, said cap being provided with a safety device, a burner valve having a lever for its pressing-off in order to emit to the atmosphere gaseous fuel stored within the body, said cap in the upper portion being provided with a rectangular cut-out positioned perpendicularly to a longitudinal axis of said body, said safety device comprising a button in the form of a rectangular plate disposed in the upper portion of said cap and movable in guide means along said cut-out in a direction perpendicular to said longitudinal axis of the lighter body, a spring for returning said button to the initial position after the pressure applied on it on the part of a user has been removed, said button in the form of the rectangular plate being provided with two protrusions directed toward the piezo-element, each of which protrusions is in the form of a wall or barrier, one of said button protrusions disposed from the side of the cap sidewall being a support member having a socket for mounting therein one end of said button spring, another end of which is brought into contact with a support on the cap, the other of said protrusions being located between the free end of said burner valve lever and said piezo-element, said guide means for button movement comprising longitudinal protrusions in walls of said cut-out in said cap and longitudinal grooves in side walls of the button, in the area between said piezo-element and said button protrusion, which is a support member for the button spring, the body is provided with a protrusion directed toward said button, said protrusion being positioned by its height with a gap with respect to the lower edge of the protrusion which is the support member for said button spring, said body being provided with a support for said burner valve lever, which support is located in the area between said burner valve and said piezo-element to provide rocking of said lever when its free end is depressed by said button protrusion and to provide pressing-off of said burner valve in order to emit the gaseous fuel to the atmosphere, wherein the free end of said burner valve lever and one of said button protrusions are disposed, with respect to the piezo-element, from the side of said burner valve, while the other button protrusion, which is the support member for said button spring, and said body protrusion are located by the other side of the piezo-element in the area of a sidewall of the cap from the side opposite the burner valve position.

5. A piezoelectric gas lighter with a safety device designed to prevent children from the possibility of igniting the lighter, comprising:

a driven cap disposed in the upper portion of the body and spring-pressed relative to the body and movable in direction along the body, said cap being provided with a safety device, a burner valve having a lever for its pressing-off in order to emit to the atmosphere gaseous fuel stored within the body, said cap in the upper portion being provided with a rectangular cut-out positioned perpendicularly to a longitudinal axis of said body, said safety device comprising a button in the form of a rectangular plate disposed in the upper portion of said cap and movable in guide means along said cut-out in a direction perpendicular to said longitudinal axis of the lighter body, a spring for returning said button to the initial position after the pressure applied on it on the part of a user has been removed, said button in the form of the rectangular plate being provided with a protrusion directed toward the piezo-element, said protrusion is in the form of a wall or barrier located from the side of a side wall of said cap and is a support member having a socket for mounting therein one end of said button spring, another end of which is brought into contact with a support on the cap, said button in the form of the rectangular plate is also provided with legs directed toward the piezo-element, said legs being disposed with a gap with respect to the piezo-element such that said piezo-element is positioned between said legs, said guide means for button movement comprising longitudinal protrusions in walls of said cut-out in said cap and longitudinal grooves in side walls of the button, in the area between said piezo-element and said button protrusion, which is a support member for the button spring, the body is provided with a protrusion directed toward said button, said protrusion being positioned by its height with a gap with respect to the lower edge of the protrusion which is the support member for said button spring, said body being provided with a support for said burner valve lever, which support is located in the area between said burner and said piezo-element to provide rocking of said lever when its free end is depressed by said legs of the button and to provide pressing-off of said burner valve in order to emit the gaseous fuel to the atmosphere, wherein the free end of said burner valve lever and said button legs are disposed, with respect to the piezo-element, from the side of said burner valve, while said button protrusion in the form of the wall, which is the support member for said button spring, and said body protrusion are located by the other side of the piezo-element in the area of a side wall of the cap from the side opposite the burner valve position.

* * * * *